United States Patent [19]

Van Becelaere

[11] Patent Number: 4,610,197

[45] Date of Patent: Sep. 9, 1986

[54] DAMPER BLADE CONSTRUCTION

[75] Inventor: Robert M. Van Becelaere, Prairie Village, Kans.

[73] Assignee: Philips Industrial Components, Inc., Dayton, Ohio

[21] Appl. No.: 744,041

[22] Filed: Jun. 12, 1985

[51] Int. Cl.[4] ..... F24F 13/14

[52] U.S. Cl. ..... 98/110; 98/114; 98/121.2; 137/601; 251/305

[58] Field of Search ..... 137/601; 251/356, 305, 251/308; 98/110, 121.2, 114, 1

[56] References Cited

U.S. PATENT DOCUMENTS

| | | | |
|---|---|---|---|
| 2,022,640 | 11/1935 | Ullmann . | |
| 3,084,715 | 4/1963 | Scharres . | |
| 3,191,241 | 6/1965 | Johnson | 98/110 |
| 3,547,152 | 12/1970 | Hess . | |
| 3,771,559 | 11/1973 | Alley . | |
| 3,885,347 | 5/1975 | Adachi et al. . | |
| 3,894,481 | 7/1975 | Alley . | |
| 3,918,283 | 11/1975 | Kosch et al. . | |
| 4,256,143 | 3/1981 | Magill et al. . | |
| 4,275,762 | 6/1981 | Field . | |

FOREIGN PATENT DOCUMENTS

| | | | |
|---|---|---|---|
| 1054432 | 5/1979 | Canada . | |
| 2364389 | 4/1978 | France | 137/601 |

*Primary Examiner*—Larry L. Schwartz

*Attorney, Agent, or Firm*—Kokjer, Kircher, Bradley, Wharton, Bowman & Johnson

[57] ABSTRACT

A hollow airfoil damper blade formed by sheet metal. The walls of the blade are formed by two sheets crimped together at the edges. The blade tapers from the center toward the edges and has two pairs of V-shaped stiffening ribs formed by corrugations in the sheets. The ribs project nearly one half the blade thickness to enhance the strength of the blade and its resistance to deflection. The ribs cooperate to form a channel which closely receives a stub axle in each of its ends to provide for pivotal mounting of the damper blade. The axles are contacted directly by and welded to each of the ribs.

20 Claims, 3 Drawing Figures

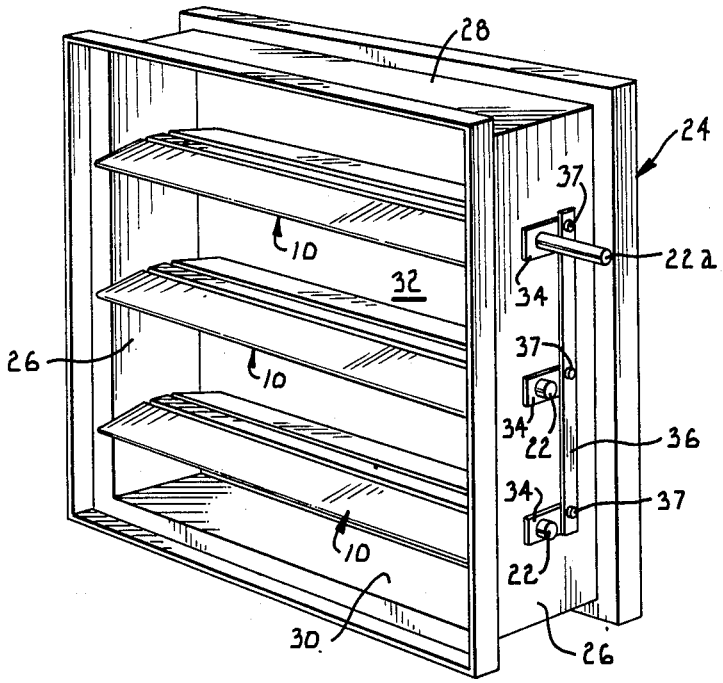
Fig. 1.
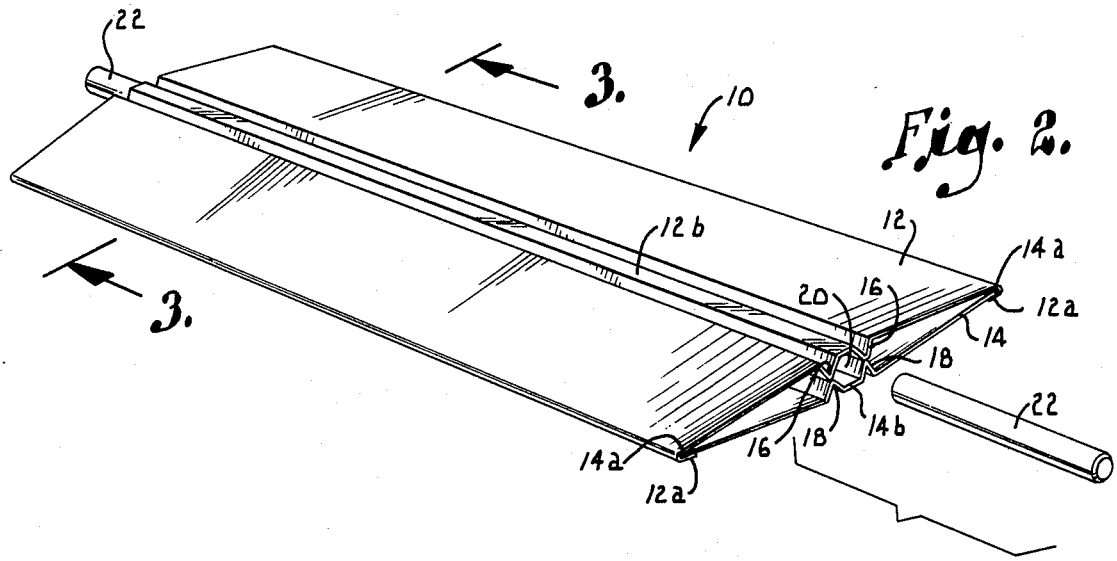
Fig. 2.
Fig. 3.
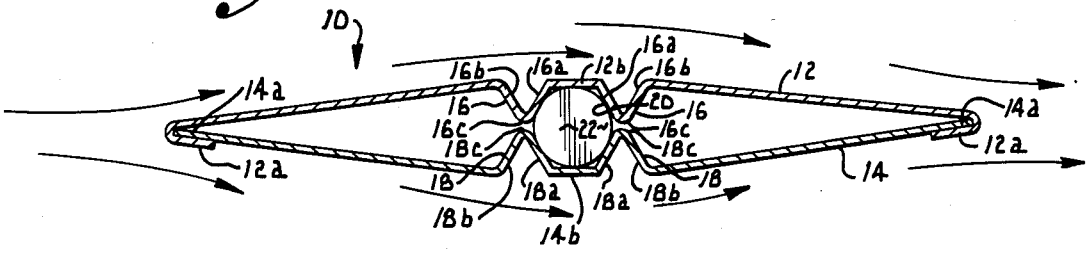

DAMPER BLADE CONSTRUCTION

BACKGROUND OF THE INVENTION

This invention relates generally to dampers and more particularly to an improved damper blade having an air foil shape and a unique construction which permits the use of light gauge sheet metal while at the same time exhibiting ample strength to withstand the forces that are encountered in service of the damper.

Dampers have long been used in a variety of fluid handling applications to control the flow of various types of fluids. Typical uses of industrial dampers include the handling of process control fluids, the handling of fluids in power plants, and the handling of high speed fan discharge streams. Industrial dampers are usually subjected to relatively high pressures and must have considerable strength in order to be capable of withstanding the forces that are applied to them.

The damper construction normally includes a rigid frame which defines a flow passage controlled by a plurality of damper blades that pivot between open and closed positions. The blades are often interconnected by a linkage which moves all of them in unison to control the fluid flow rate in accordance with the damper blade position. Although flat damper blades are often used, it has long been recognized that airfoil shapes can be used to enhance the fluid flow. Airfoil blades are thickest in the center at the pivot axis and taper toward each edge to present an aerodynamically efficient shape which minimizes turbulence and other undesirable effects such as noise generation and stresses on the flow passage and other components of the fluid handling system.

In the past, airfoil shaped blades have been formed for the most part by extrusion processes. Extrusion techniques have the advantage of allowing the airfoil shape to be extruded in long sections and then cut into individual damper blades having the required lengths. However, the extrusion process is disadvantageous in a number of respects, most notably in its relatively high costs, relatively high energy requirements, and limitations in the materials that can be used to construct the blades.

It has been found that sheet steel can be bent into an airfoil shape at a reduced cost in comparison to the extrusion of materials such as aluminum. However, in order to provide the sheet metal damper blade with sufficient strength to withstand the considerable forces that are encountered, it has been necessary to use relatively heavy gauge sheet metal to construct the damper blade. This increases both the weight and cost of the blade. An additional problem with sheet metal blades is that the damper axle must either extend completely through the blade or the blade must be reinforced by a full length tube in order to adequately support the blade and maintain it properly centered on the axle. Both of these alternatives require added material, and the cost and weight are increased accordingly.

SUMMARY OF THE INVENTION

The present invention provides an airfoil shaped damper blade which is constructed of sheet metal and has a unique configuration which overcomes the problems that have plagued sheet metal blades in the past. In accordance with the invention, a pair of steel sheets are crimped together at their edges to form a hollow airfoil shape which tapers toward both edges from a relatively thick central portion. In the center region of the blade, each sheet is corrugated to form a pair of V-shaped ribs which extend approximately half the thickness of the blade and which greatly enhance its structural strength.

In addition to increasing the blade strength, the ribs cooperate to form a substantially enclosed channel which extends completely through the center of the blade along its full length. A pair of stub axles extend into the opposite ends of the channel and permit the blade to be pivotally mounted on a supporting frame. The axles are in direct contact on all sides with the surfaces of the ribs and are welded or otherwise rigidly secured to the ribs. This manner of connecting the axles with the damper blade provides a sturdy connection which eliminates the need for a full length axle and the need for installing reinforcement tubes or other added reinforcing members to the blade.

The blade construction of the present invention, and particularly the arrangement and location of the ribs, allows the use of sheet metal that is thinner than has been possible in the past. This is highly desirable in that it reduces both the cost and weight of the blade without sacrificing strength. The ribbed configuration prevents the damper blade from bowing or otherwise deflecting significantly when subjected to high fluid pressures. At the same time, the stub axles are closely surrounded by and rigidly secured to the ribs to provide a rigid and low cost mounting arrangement which adequately supports the blade and maintains it properly in place within the damper opening of the frame.

DETAILED DESCRIPTION OF THE INVENTION

In the accompanying drawing which form a part of the specification and is to be read in conjunction therewith and in which like reference numerals are used to indicate like parts in the various views:

FIG. 1 is a perspective view of a flow control damper equipped with damper blades constructed according to a preferred embodiment of the present invention, with each blade in the fully open position;

FIG. 2 is a perspective view on an enlarged scale of one of the damper blades shown in FIG. 1, with one of the stub axles exploded away from the blade for purposes of illustration; and FIG. 3 is a sectional view on an enlarged scale taken generally along line 3—3 of FIG. 2 in the direction of the arrows.

Referring now to the drawing in more detail, numeral 10 generally designates an airfoil damper blade constructed in accordance with the present invention. With particular reference to FIG. 2, the damper blade 10 is formed from a pair of relatively thin sheet members 12 and 14 which may be galvanized steel sheets. Each sheet 12 and 14 is initially flat, and the sheets are bent into the shapes shown by suitable sheet forming techniques. The opposite side edges of the upper sheet 12 are bent back on themselves to provide flanges **12*a* which underlie and are crimped onto the free side edges 14*a* of the lower sheet 14. By crimping the edges of the upper sheet 12 onto the free edges 14*a*** of the lower sheet, the two sheet members are rigidly interlocked along both of their side edges. The edges of the blade are parallel.

Blade 10 has a hollow airfoil shape best shown in FIG. 3. The sheets 12 and 14 form the walls of the blade, and the walls converge toward the interlocked edges to give the blade a tapered profile. Center portions 12*b* and 14*b* of the respective upper and lower sheets 12 and 14 are spaced apart from one another to provide the center portion of the blade with a preselected thickness. The blade gradually tapers from the center portion toward each of the opposite edges, and the blade is preferably symmetrical about its center portion.

The upper sheet 12 is provided with a pair of spaced apart ribs 16 adjacent the center portion 12*b*. The ribs 16 are formed by corrugations in sheet 12 and serve as stiffeners which enhance the strength of the damper blade. Each rib 16 has a V-shaped configuration and extends into the interior of the blade a distance substantially equal to but slightly less than one half the thickness of the blade between the center portions 12*b* and 14*b* of the sheet members. Each rib 16 extends the full length of blade 10 and includes a pair of sloped walls 16*a* and 16*b* which meet at an apex 16*c* of the rib.

The lower sheet 14 has a similar pair of ribs 18 formed by corrugations located adjacent the center portion 14*b* of the sheet. Ribs 18 are spaced apart from one another the same distance as ribs 16 and project from sheet 14 a distance substantially equal to but slightly less than one half the thickness of the damper. Each rib 16 is V-shaped and includes a pair of walls 18*a* and 18*b* which meet at an apex 18*c* of the rib. The ribs 16 and 18 oppose one another and nearly touch at their apices. Preferably, only a small gap is formed between each pair of opposing ribs, with the gap being less than 0.1 inch in the preferred form of the invention. The apices of the ribs can actually touch if desired.

The inside walls 16*a* and 18*a* cooperate with the center portions 12*b* and 14*b* to provide a substantially enclosed channel 20 which extends centrally through the damper blade 10 along its full length. The channel 20 is bounded on all sides by the ribs and is open on its opposite ends located at the opposite ends of the blade.

The damper blade 10 includes a pair of identical stub axles 22 which extend into the opposite ends of channel 20. The stub axles 22 are solid members each much shorter than blade 10 and each having a diameter to fit closely in the channel 20 in direct contact with the inside surfaces of walls 16*a* and the inside surfaces of walls 18*a*, as best shown in FIG. 3. Each axle 22 is also in direct contact with the inside surfaces of the center portions 12*b* and 14*b* of the upper and lower sheets 12 and 14. Each axle 22 is welded or otherwise rigidly secured to each of the rib walls 16*a* and 18*a* and each of the center portions 12*b* and 14*b* of the sheet members. In this manner, the two relatively short stub axles 22 are secured to the damper blade in axial alignment with one another to establish a pivot axis for opening and closing of the damper blade 10. The rigid connection of axles 22 to blade 10 effects turning of the blade when the axles are turned.

Referring now to FIG. 1, a plurality of the damper blades 10 may be installed on a rigid damper frame 24 having opposite sides 26, a top portion 28, and a bottom portion 30. The frame 24 is normally installed in a fluid flow passage, a portion of which is formed by a damper opening 32 presented within the frame between the sides and the top and bottom of the frame. The two stub axles 22 of each damper 10 are supported for pivotal movement on the opposite sides 26 of the frame. Each axle 22 is rigidly connected with a crank arm 34 located adjacent to one of the frame sides 26, and all of the crank arms 34 are connected by a vertical link 36 pivoted at 37 to the crank arms. This arrangement pivots the blades 10 in unison between the fully opened position shown in FIG. 1 and the fully closed position wherein the damper blades are oriented vertically to close the damper opening 32. The damper blades can be positioned anywhere between the fully opened and the fully closed positions. Preferably, one of the axles 22 is extended as indicated at 22*a* in FIG. 1 for the upper damper blade so that the extension 22*a* can be driven by a suitable power operated actuator (not shown). The actuator turns shaft 22*a* and, through the linkage arrangement, simultaneously turns the axles 22 for the other dampers in the same direction to rotate all of the dampers in unison.

Due to the provision of the two pairs of ribs 16 and 18 near the center of the damper 10, the strength of the damper is greatly increased in comparison to dampers which are lacking in stiffening ribs or provided only with relatively shallow ribs. The opposing ribs 16 and 18 do not allow the two sheets 12 and 14 to collapse toward one another to any significant extent, and the ribs also resist bowing and other deflection of the blade. Calculations have shown that a blade having an 8 inch width and $\frac{3}{4}$ inch diameter axles can be increased in its strength by approximately 108 percent due to the presence of the stiffening ribs 16 and 18. Additionally, a gain in the moment of inertia of approximately 103 percent is provided for enhanced resistance to bowing and other deflection.

The enhanced stiffening of the center portion of the blade provided by the ribs 16 and 18 eliminates the need to add separate reinforcement tubes or other reinforcement members and also eliminates the need for a single axle to extend completely through the blade. The rib walls 16*a* and 18*a* and the center portions 12*b* and 14*b* of the upper and lower sheet members provide surfaces which directly contact the stub axles 22 along substantially their entire outside surfaces, thereby providing significant areas of contact between the damper blade and axles.

Because of the enhanced strength and resistance to deflection provided by the ribs 16 and 18, the sheet members 12 and 14 can be relatively light gauge sheet metal so that both the cost and the weight of the damper are reduced without sacrificing strength or other desirable performance characteristics. For example, acceptable results can be obtained from the use of galvanized steel having a gauge of 16, 18 or 20. In the past, 12 gauge sheet metal has been typical. At the same time, the ribs 16 and 18 are strategically located to provide contact surfaces which closely surround the stub axles 22. The grooves which are formed in the outer surfaces of sheets 12 and 14 are narrow enough to avoid interfering significantly with the aerodynamic efficiency of the blade as the air flows past the blade in its open position, as shown by the directional arrows in FIG. 3.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a damper blade construction, the improvement comprising:

a hollow airfoil shaped blade having opposite walls formed of sheet material and cooperating to form a central portion of the blade and a pair of generally parallel edges on opposite sides of said central portion, said walls converging toward said edges to provide the blade with a tapered configuration from said central portion toward each edge;

a first pair of stiffening ribs on said central portion of the blade projecting a substantial distance into the blade from one of said walls and formed by corrugations in the sheet material of said one wall, said ribs in the first pair extending substantially the full length of said blade and being spaced apart from one another;

a second pair of stiffening ribs on said central portion of the blade projecting a substantial distance into the blade from the other wall and formed by corrugations in the sheet material of said other wall, said ribs in the second pair extending substantially the full length of said blade and being spaced apart from one another substantially the same distance as the ribs in said first pair;

a channel extending through said central portion of the blade and having opposite ends on opposite ends of the blade, located between the ribs in said first and second pairs; and a pair of stub axles extending into said opposite ends of said channel in contact with each rib in said first and second pairs to provide a damper axis, said axles being embraced by said ribs and being rigidly secured to each of said ribs to effect turning of the blade about said damper axis in response to turning of the axles.

2. The invention of claim 1, wherein:

said central portion of the blade has a preselected thickness;

said ribs in the first pair project from said one wall a distance substantially equal to one half said preselected thickness; and said ribs in the second pair project from said other wall a distance substantially equal to one half said preselected distance.

3. The invention of claim 2, wherein said channel is bounded by and substantially enclosed by surfaces of said ribs in the first and second pairs.

4. The invention of claim 3, wherein each rib has a generally V-shaped configuration.

5. The invention of claim 1, wherein:

said one wall is formed by a first sheet member having opposite edge portions adjacent said edges; and said other wall is formed by a second sheet member having opposite edge portions interlocked with the edge portions of said first sheet member to connect the first and second sheet members.

6. The invention of claim 5, wherein said edge portions of said first and second sheets are crimped together to interlock the edge portions.

7. The invention of claim 5, wherein each edge portion of said first sheet is bent around and crimped on the corresponding edge portion of said second sheet, thereby interlocking the edge portions of said first and second sheets.

8. The invention of claim 5, wherein:

said control portion of the blade has a preselected thickness;

said ribs in the first pair project from said first sheet a distance substantially equal to one half said preselected thickness; and said ribs in the second pair project from said second sheet a distance substantially equal to said preselected distance.

9. The invention of claim 8, wherein said channel is bounded by and substantially enclosed by surfaces of said ribs in the first and second pairs.

10. The invention of claim 9, wherein each rib has a generally V-shaped configuration.

11. A damper blade construction comprising:

a hollow airfoil shaped blade having opposite walls formed of sheet material and cooperating to form a control portion of the blade having a preselected depth and a pair of generally parallel edges on opposite sides of said central portion, said walls converging toward said edges to provide the blade with a tapered configuration from said central portion toward each edge;

a first pair of spaced apart stiffening ribs on said central portion of the blade projecting into the blade from one of said walls a distance substantially equal to one half said preselected depth, said ribs in the first pair being formed by corrugations in said one wall extending substantially the full length of the blade;

a second pair of spaced apart stiffening ribs on said central portion of the blade projecting into the blade from the other wall a distance substantially equal to one half said preselected depth, said ribs in said second pair being formed by corrugations in said other wall extending substantially the full length of the blade in opposition to the corrugations which form the ribs in said first pair;

a channel extending through said central portion of the blade and defined within cooperating surfaces on said ribs in the first and second pairs, said channel having opposite ends on opposite ends of the blade; and a pair of stub axles extending into said opposite ends of the channel, said axles contacting and being secured to each of said cooperating surfaces on the ribs to rigidly secure the axles to the blade for turning of the blade in response to turning of the axles.

12. The invention of claim 11, wherein each rib has a generally V-shaped configuration.

13. The invention of claim 11, wherein:

said one wall is formed by a first sheet member having opposite edge portions adjacent said edges; and said other wall is formed by a second sheet member having opposite edge portions interlocked with the edge portions of said first sheet member to connect the first and second sheet members.

14. The invention of claim 13, wherein said edge portions of said first and second sheets are crimped together to interlock the edge portions.

15. The invention of claim 13, wherein each edge portion of said first sheet is bent around and crimped on the corresponding edge portion of said second sheet, thereby interlocking the edge portions of said first and second sheets.

16. A damper blade construction comprising:

a pair of sheet members cooperating to form a hollow airfoil shaped blade tapered from a central portion thereof toward generally parallel edge portions on opposite sides of said central portion, said sheet members being interlocked at said edge portions;

a first pair of spaced apart stiffening ribs formed by corrugations in one of said sheet members in said central portion of the blade, said ribs in the first pair projecting into the blade and extending parallel to one another substantially the full length of the blade;

a second pair of spaced apart stiffening ribs formed by corrugations in the other sheet member, said ribs in the first and second pairs cooperating to define a substantially enclosed channel bounded by surfaces of the ribs and having opposite ends; and a pair of stub axles extending into said opposite ends of the channel and cooperating to provide a damper axis about which the blade can turn, said axles contacting each of said surfaces of the ribs and being secured thereto.

17. The invention of claim 16, wherein:

each rib has a generally V-shaped configuration and presents an apex; and the apex of each rib in the first pair is located adjacent to the apex of the corresponding rib in the second pair, whereby said channel is bounded by and substantially enclosed by said surfaces of the ribs.

18. The invention of claim 16, wherein said sheet members are crimped to one another at said edge portions to connect the sheet members together.

19. The invention of claim 16, wherein said one sheet member is bent around and crimped on said other sheet member at each edge portion to the blade to thereby connect the sheet members to one another.

20. The invention of claim 17, wherein said one sheet member is bent around and crimped on said other sheet member at each edge portion to the blade to thereby connect the sheet members to one another.

* * * * *

UNITED STATES PATENT AND TRADEMARK OFFICE

CERTIFICATE OF CORRECTION

PATENT NO. : 4,610,197

DATED : September 9, 1986

INVENTOR(S) : Robert M. Van Becelaere

It is certified that error appears in the above-identified patent and that said Letters Patent are hereby corrected as shown below:

Claim 8, line 2, "control" should read --central--.

Claim 11, line 4, "control" should read --central--.

Signed and Sealed this

Sixth Day of January, 1987

*Attest:*

DONALD J. QUIGG

*Attesting Officer*

*Commissioner of Patents and Trademarks*